US006837082B1

(12) United States Patent
Moore

(10) Patent No.: US 6,837,082 B1
(45) Date of Patent: Jan. 4, 2005

(54) DOOR SECURITY SYSTEM

(76) Inventor: Otis Moore, 4740 Genevive, San Bernardino, CA (US) 92407

( * ) Notice: Subject to any disclaimer, the term of this patent is extended or adjusted under 35 U.S.C. 154(b) by 43 days.

(21) Appl. No.: 10/457,761

(22) Filed: Jun. 9, 2003

(51) Int. Cl.[7] ..... E05B 35/08

(52) U.S. Cl. ..... 70/337; 70/103; 70/417; 70/108

(58) Field of Search ..... 49/67, 394; 70/337, 70/DIG. 16, 103, 417, 418, 108, 94; 292/259 R, 338

(56) References Cited

U.S. PATENT DOCUMENTS 4,026,070 A * 5/1977 Hicks ..... 49/55
4,644,688 A * 2/1987 Benderoff ..... 49/67
4,763,499 A 8/1988 Boyle ..... 70/417
5,154,461 A 10/1992 Prescott et al. ..... 292/346
5,171,050 A * 12/1992 Mascotte ..... 292/341.18
5,406,814 A * 4/1995 Zeager et al. ..... 70/102
5,566,995 A 10/1996 Jagiela ..... 292/346
5,586,796 A * 12/1996 Fraser ..... 292/346
5,595,408 A * 1/1997 Jeche ..... 292/37
5,802,765 A * 9/1998 Vickery ..... 49/67
5,910,076 A * 6/1999 Gladney ..... 49/55
6,212,391 B1 * 4/2001 Saleh et al. ..... 455/456.4
6,263,949 B1 * 7/2001 Guthrie, Jr. ..... 160/380
6,357,509 B1 * 3/2002 Lamazares ..... 160/210
6,666,054 B1 * 12/2003 Hsieh ..... 70/257

* cited by examiner

*Primary Examiner*—John B. Walsh
(74) *Attorney, Agent, or Firm*—Goldstein Law Offices, P.C.

(57) ABSTRACT

A door security system for use in conjunction with a building having an existing doorway, for providing enhanced security to the occupants of the building. The door security system has a steel door hingeably attached to a steel doorframe. The steel door has a plurality of evenly spaced steel vertical rods, and a plurality of metal plates which overlay and are attached to the vertical rods, thereby conferring great strength to the door. The central plate has two deadbolt locks, and a cover plate in proximity to the deadbolt locks. The cover plate prevents an individual from inserting an object between the door and the doorframe, in an attempt to push the lock bolts from their corresponding bolt recesses within the doorframe. The door security system may be installed within any suitably sized doorway within the existing building to provide a sense of security to the occupants.

13 Claims, 2 Drawing Sheets

DOOR SECURITY SYSTEM

BACKGROUND OF THE INVENTION

1. Field of the Invention

The invention generally relates to a door security system for a building, and in particular it relates to a door security system having a steel door hingeably attached to a steel doorframe, having features for preventing unauthorized access to the building through the door security system.

2. Description of the Related Art

A large number of homes and businesses are broken into and burglarized every year. There are a variety of ways a burglar may enter a building. Often, however, the burglar will simply enter the building through a door of the building. This may be accomplished in several ways. Firstly, the burglar may actually break the door in order to gain access to the interior of the building. Secondly, the burglar may remove the door from its hinges in order to enter the building. Thirdly, the burglar may break open the locks which maintain the door in a closed and locked position. Consequently, there is a need for a door security system having features which make it difficult or impossible for the burglar to enter the building through the door in the several ways described above.

A variety of door security systems are available. For example, U.S. Pat. No. 4,763,499 to Boyle appears to show a door security system comprised of a wrap around cover plate for protecting hinges. Additionally, U.S. Pat. No. 5,154,461 to Prescott appears to show a door security system with a reinforced metal plate imbedded across the width for preventing unauthorized entry. Furthermore, U.S. Pat. No. 5,566,995 to Jagiela appears to show a door security system comprised of a plate secured to the inner side of a door.

While these devices may be suitable for the particular purpose employed, or for general use, they would not be as suitable for the purposes of the present invention as disclosed hereafter.

SUMMARY OF THE INVENTION

It is an object of the invention to produce a door security system for a building which provides a sturdy doorframe which is not easily broken by a burglar attempting to gain access to the building. Accordingly, the door security system comprises a steel doorframe, which is extremely difficult for the burglar to destroy in an attempt to gain access to the building.

It is another object of the invention to provide a door security system having a door which is not easily broken by a burglar. Accordingly, the door security system has a steel door having a plurality of vertical steel rods and a plurality of flat sheet metal plates which overlay the vertical rods, thereby making it extremely difficult for a burglar to break the door in order to gain access to the building.

It is an additional object of the invention to produce a door security system having a door having locks which are not easily circumvented. Accordingly, the door security system has two deadbolt locks and a steel cover plate positioned in proximity to the deadbolt locks, for preventing the burglar from sliding objects between the door and doorframe in an attempt to push the lock bolts from the corresponding bolt recesses within the doorframe.

It is yet another object of the invention to produce a door security system which is well suited for use with either a residential dwelling or with a commercial building.

Accordingly, the door security system may be installed into any suitably sized existing doorway, and is well suited for use with either a residential dwelling or with a commercial building.

Further objects of the invention will become apparent in the detailed description of the door security system that follows.

The invention is a door security system for use in conjunction with a building having an existing doorway, for providing enhanced security to the occupants of the building. The door security system has a steel door hingeably attached to a steel doorframe. The steel door has a plurality of evenly spaced steel vertical rods, and a plurality of metal plates which overlay and are attached to the vertical rods, thereby conferring great strength to the door. The central plate has two deadbolt locks, and a cover plate in proximity to the deadbolt locks. The cover plate prevents an individual from inserting an object between the door and the doorframe, in an attempt to push the lock bolts from their corresponding bolt recesses within the doorframe. The door security system may be installed within any suitably sized doorway within the existing building to provide a sense of security to the occupants.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
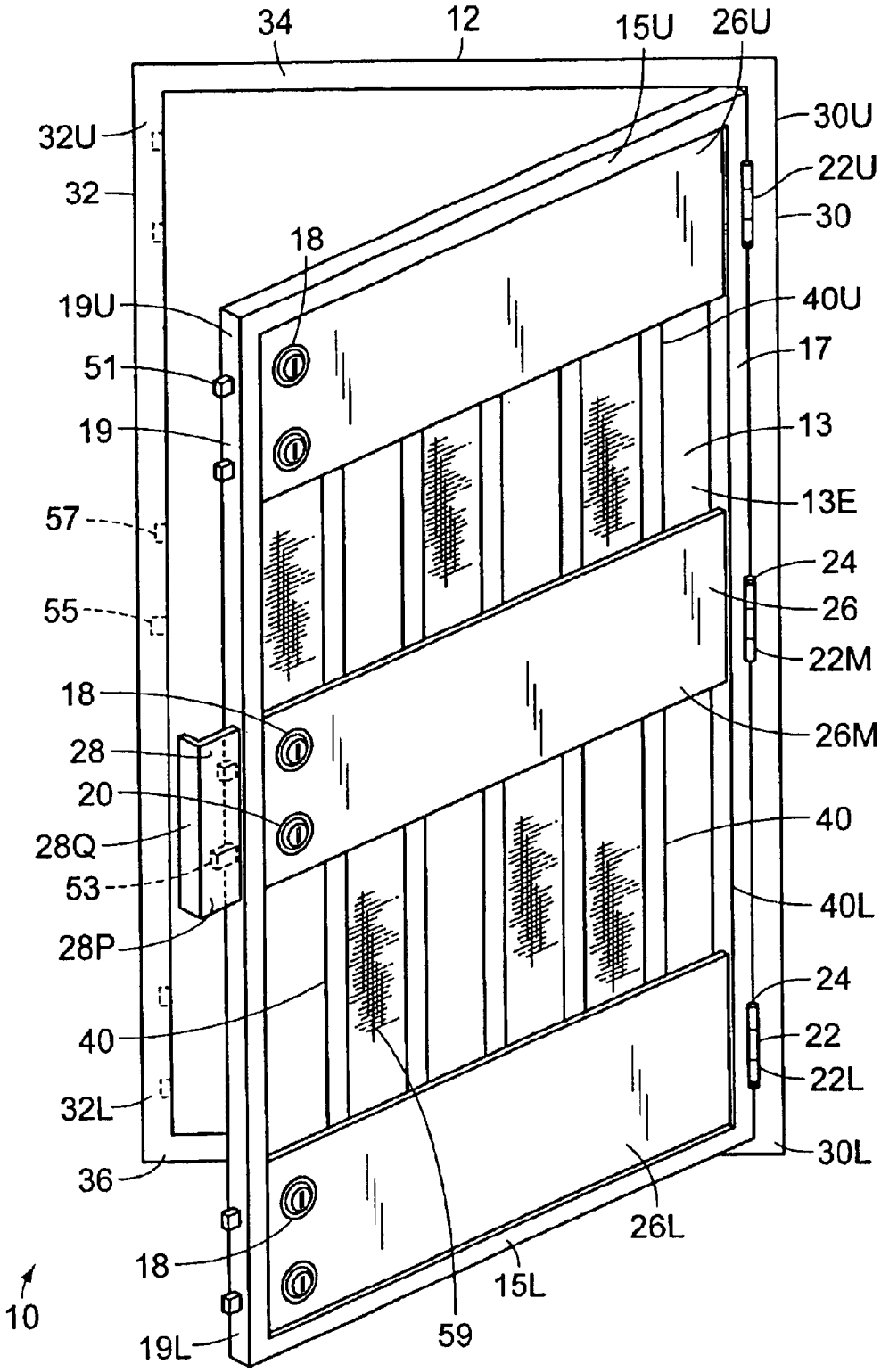
FIG. 1 is a perspective view of a door security system in an open position.

FIG. 1 illustrates a door security system 10, for use in conjunction with a building having an inside and an outside, said building having an existing doorway, said door security system 10 for preventing unauthorized entry into the building through the doorway. The door security system 10 comprises a substantially rectangular steel doorframe 12, and a substantially rectangular steel door 13 sized to selectively fit within the doorframe 12. The door 13 has an externally oriented surface 13E facing the outside of the building, and an opposing internally oriented surface which faces the inside of the building. In FIG. 1, the externally oriented surface 13E is visible. The door security system 10 has three hinge assemblies 22 for hingeably attaching the door 13 to the door frame 12 and for allowing the door 13 to swivel with respect to the doorframe 12. The door security system 10 has an open position and a closed position. In the closed position, the door 13 fits snugly within the doorframe 12. In the open position, the door 13 has been swiveled upon the hinge assemblies 22 which connect the door 13 to the doorframe 12, thereby allowing an individual to enter the building through the door 13. The door security system 10 further has a range of partially open positions, wherein the door 13 has been partially swiveled open upon the hinge assemblies 22. The door security system 10 is attached to the existing doorway and has various features which prevent unauthorized entry into the building through the existing doorway. These features are described below.

The doorframe 12 comprises a hinged vertical bar 30, a non-hinged vertical bar 32, an upper horizontal bar 34, and a lower horizontal bar 36. The vertical bars 30 and 32 each have an upper portion 30U and 32U, respectively, and also a lower portion, 30L and 32L respectively. The upper horizontal bar 34 rigidly connects the upper portion 32U of the non-hinged vertical bar 32 to the upper portion 30U of the hinged vertical bar 30. Likewise, the lower horizontal bar 36 rigidly connects the lower portion 32L of the non-hinged vertical bar 32 to the lower portion 30L of the hinged vertical bar 30.

The door 13 has a horizontal upper edge 15U, a horizontal lower edge 15L, a vertical hinged edge 17, and a vertical free edge 19. The free edge 19 has an upper portion 19U and a lower portion 19L. The three hinge assemblies 22 include an uppermost hinge assembly 22U, a middlemost hinge assembly 22M, and a lowermost hinge assembly 22L. The hinge assemblies 22 attach the hinged edge 17 of the door 13 to the hinged vertical bar 30 of the doorframe 12. Each hinge assembly 22 has an associated hinge pin 24 extend vertically therethrough. The hinge pin 24 of the middlemost hinge assembly 22M points downward. The hinge pins 24 of the uppermost hinge assembly 22U and the lowermost hinge assembly 22L both point upward. This feature makes it more difficult for an unauthorized individual to remove the door 13 from the doorframe 12 by removing the hinge pins 24 from their associated hinge assemblies 22.

The door 13 has five evenly spaced steel vertical rods 40, each having a lower portion 40U and an upper portion 40L. Each of the lower portions 40L is welded to the horizontal lower edge 15L of the door 13. Likewise, each of the upper portions 40U is welded to the horizontal upper edge 15U of the door 13. The welded vertical rods 40 make it difficult for the unauthorized individual to break through the door 13 in an attempt to enter into the building.

The door 13 has three substantially flat rectangular sheet metal plates 26 extending fully from the hinged edge 17 to the free edge 19 of the door 13. In particular, the door 13 has an upper metal plate 26U, a central metal plate 26M, and a lower metal plate 26L. The sheet metal plates 26 overlay and are welded to the vertical rods 40, and thereby confer additional strength to the door 13. The door 13 has a locked and an unlocked position. The central metal plate 26M has two vertically aligned deadbolt locks 18 and 20, each having an associated bolt, 51 and 53, respectively, for selectively maintaining the door 13 in the locked and the unlocked position. Correspondingly, the non-hinged vertical bar 32 of the door frame 12 has two bolt recesses, 57 and 55, each positioned to engage one of the bolts 51 and 53, respectively, of the deadbolt locks 18, 20, when the door 13 is in the locked position. The deadbolt lock 20 has a bolt 53 which is substantially longer then the bolt 51 of a usual lock 18, in order to further thwart attempts by the unauthorized individual to gain access to the building by disengaging said bolt 53 from its corresponding bolt recess 55 within the door frame 12. In an alternate embodiment, the door 13 has six additional auxiliary locks 18, each having an auxiliary bolt 51, affixed to the free edge 19 of the door 13. In such an embodiment, the doorframe 12 correspondingly has six additional auxiliary bolt recesses 57, each positioned to selectively engage one of the auxiliary bolts 51, thereby making it even more difficult for the unauthorized individual to break into the building. The auxiliary locks 18 are vertically aligned and substantially evenly spaced apart from each other, and extend from the upper portion 19U to the lower portion 19L of the free edge 19 of the door 13.

The central metal plate 26M has a cover plate 28 having a projecting portion 28P which is coplanar with the door 13 and which extends beyond the free edge 19 of the door 13. The cover plate 28 also has a perpendicular portion 28Q extending perpendicularly inward from the projecting portion 28P, toward the internally oriented surface of the door 13. The perpendicular portion 28Q prevents the unauthorized individual from inserting thin objects between the door 13 and the doorframe 12, in proximity to the deadbolt locks 18 and 20, during an attempt to push the bolts from their corresponding recesses, in order to open the door 13 while it is in the locked position.

The externally oriented surface 13E of the door 13 is covered by a steel mesh screen. The door 13 is preferably eighty inches in height, thirty-six inches in width, and two inches in thickness. The horizontal upper edge 15U, the horizontal lower edge 15L, the free edge 19, and the hinged edge 17 are each constructed from hollow steel beams. Similarly, the upper horizontal bar 34, the lower horizontal bar 36, the non-hinged vertical bar 32, and the hinged vertical bar 30 of the doorframe 12 are each constructed from hollow steel beams. The sheet metal plates 26 each have a height of approximately twelve inches. The door security system 10 is installed into the existing doorway at a position which is external to the externally oriented surface of the existing door, thereby providing enhanced security to the occupant of the building.

Figure 2:
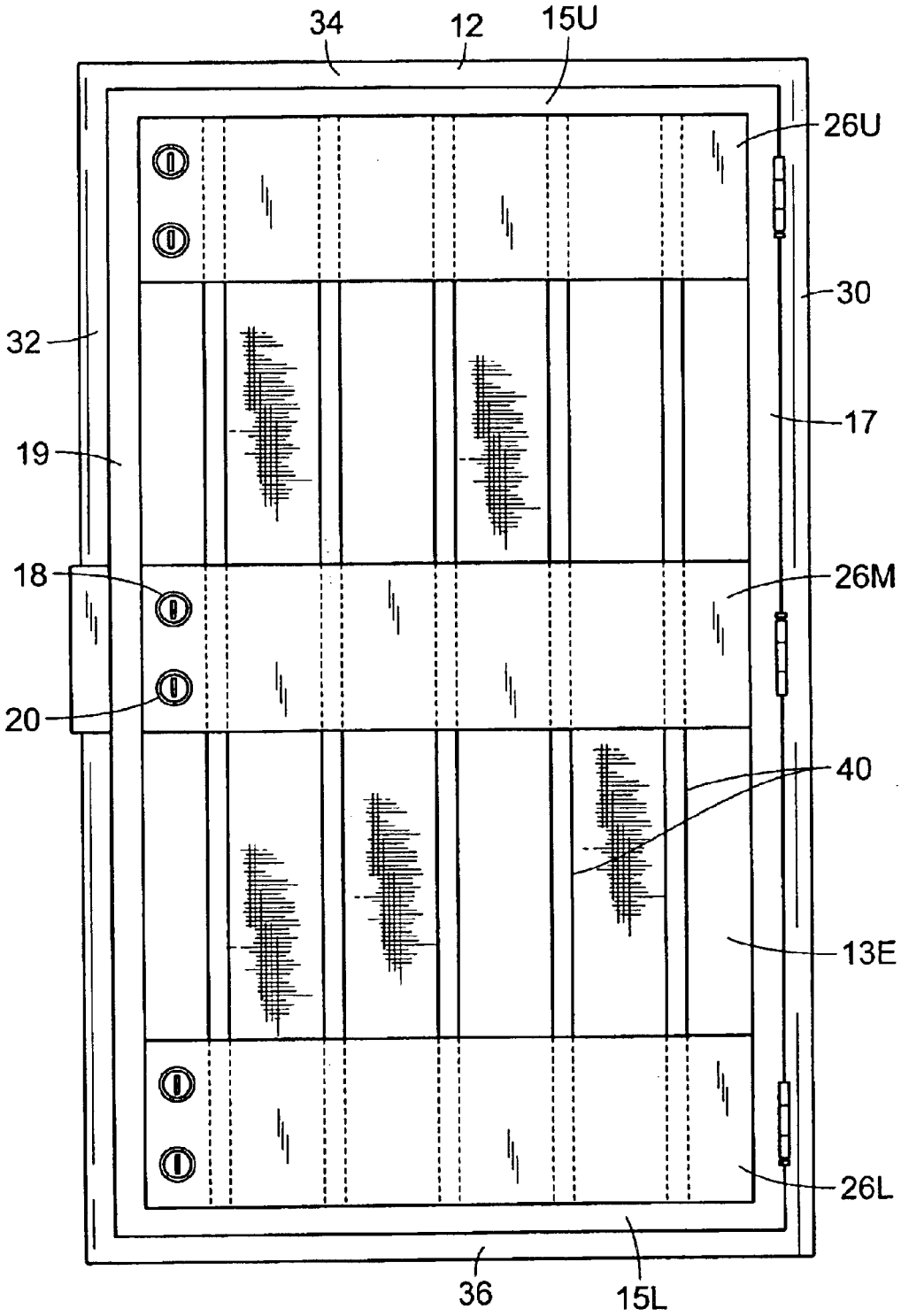
FIG. 2 is a front elevational view of the door security system in a closed position.

FIG. 2 illustrates a view of the door security system 10 in the closed position, wherein the externally oriented surface 13E of the door 13 is visible. The door 13 is substantially flush against the doorframe 12. Portions of the vertical rods 40 which underlie the plates 26 are shown with hatched lines.

In use, the door security system 10 is used in conjunction with an existing doorway having an existing door. The frame 12 of the door security system 10 is positioned within the existing doorway, at a position which is external to the externally oriented surface of the existing door. The doorframe 12 is then attached to the existing doorway. The hinged edge 17 of the door 13 is attached to the hinged vertical bar 30 of the doorframe 12 by the hinge assemblies 22. The hinge pins 24 are inserted within their associated hinge assemblies 22 in order to anchor the door 13 to the doorframe 12. The occupant may now use the building with an enhanced sense of security provided by the door security system 10.

In conclusion, herein is presented a door security system for use in conjunction with a building having an existing doorway, for providing enhanced security to the occupants of the building. The invention is illustrated by example in the drawing figures, and throughout the written description. It should be understood that numerous variations are possible, while adhering to the inventive concept. Such variations are contemplated as being a part of the present invention.

What is claimed is:

1. A door security system, for use in conjunction with a building having an outside and an inside, said building having an existing doorway, for preventing entry into the building through the doorway by an unauthorized individual, comprising:

a substantially rectangular metal doorframe for attachment within the existing doorway, said doorframe having a hinged vertical bar, a non-hinged vertical bar, an upper horizontal bar, and a lower horizontal bar, wherein the vertical bars each have an upper portion and a lower portion, wherein the upper horizontal bar rigidly connects the upper portion of the non-hinged vertical bar to the upper portion of the hinged vertical bar, and wherein the lower horizontal bar rigidly connects the lower portion of the non-hinged vertical bar to the lower portion of the hinged vertical bar, wherein the non-hinged vertical bar has two substantially horizontal bolt recesses extending partially therethrough; and a substantially rectangular metal door sized to selectively fit within the doorframe, said door having an externally oriented surface facing the outside of the building and an internally oriented surface facing the inside of the building, said door having a horizontal upper edge, a horizontal lower edge, a vertical hinged edge, and a vertical free edge, said door having a plurality of hinge assemblies for attaching the hinged edge of the door to the hinged vertical bar of the door frame, said door having a closed position wherein the door is fitted snugly within the door frame and an open position wherein the door has been swiveled away from the door frame upon the hinge assemblies, said free edge of the door having an upper portion and a lower portion, said door having a plurality of evenly spaced steel vertical rods extending substantially between the lower edge and the upper edge of the door, each of said vertical rods having a lower portion and an upper portion, said door further having a plurality of substantially flat metal plates extending substantially from the hinged edge to the free edge of the door, said plates for conferring additional strength to the door, said door further having two deadbolt locks, each having a selectively extendable bolt for selectively engaging the bolt recesses within the doorframe, said door having a locked position wherein at least one of the bolts is extended within one of the bolt recesses of the doorframe, said door also having an unlocked position wherein each of the bolts has been retracted within the associated deadbolt lock, said deadbolt locks positioned in proximity to the free edge of the door, wherein the door has three metal plates extending substantially from the hinged edge to the free edge of the door, namely, an upper plate, a central plate, and a lower plate, wherein the two deadbolt locks are positioned within the central plate at a location in proximity to the free edge of the door.

2. The door security system as recited in claim 1, wherein the central plate has a cover plate having a projecting portion which is coplanar with the door and also a perpendicular portion extending perpendicularly therefrom, for preventing the unauthorized individual from inserting objects between the door and the doorframe, in proximity to the deadbolt locks, during an attempt to push the bolts from the corresponding recesses within the doorframe, in order to gain access to the building.

3. The door security system as recited in claim 2, wherein one of the deadbolt locks has a bolt which is substantially longer then the other deadbolt lock, in order to further thwart attempts by the unauthorized individual to push said bolt out from its corresponding bolt recess within the doorframe, in order to gain access to the building.

4. The door security system as recited in claim 3, wherein the door has three hinge assemblies, namely, an uppermost hinge assembly, a middlemost hinge assembly, and a lowermost hinge assembly, wherein each hinge assembly has an associated hinge pin, wherein the hinge pin of the middlemost hinge assembly points downward, and wherein the hinge pins of the uppermost hinge assembly and the lowermost hinge assembly both point upward, thereby making it more difficult for an unauthorized individual to remove the door from the doorframe.

5. The door security system as recited in claim 4, wherein the door has five evenly spaced steel vertical rods.

6. The door security system as recited in claim 5, wherein each of the lower portions of the vertical rods is welded to the horizontal lower edge of the door, and wherein each of the upper portions of the vertical rods is welded to the horizontal upper edge of the door, in order to confer additional strength to the door.

7. The door security system as recited in claim 6, wherein the plates are constructed from sheet metal.

8. The door security system as recited in claim 7, wherein the plates overlay the vertical rods and are welded to the vertical rods, thereby conferring additional strength to the door.

9. The door security system as recited in claim 8, wherein the externally oriented surface of the door is covered by a steel mesh screen.

10. The door security system as recited in claim 9, further having a plurality of auxiliary locks positioned within the free edge of the door, wherein said auxiliary locks are substantially evenly spaced apart and extend from the upper portion to the lower portion of the free edge of the door, said auxiliary locks for making it more difficult for the unauthorized person to break into the building.

11. The door security system as recited in claim 10, wherein the horizontal upper edge, the horizontal lower edge, the free edge, and the hinged edge of the door are each constructed from hollow metal beams.

12. The door security system as recited in claim 11, wherein the non-hinged vertical bar, the hinged vertical bar, the lower horizontal bar, and the upper horizontal bar of the doorframe are each constructed from hollow metal beams.

13. A method of using a door security system, in conjunction with a building having an outside and an inside, said building having an existing doorway having an existing door, for protecting an occupant of the building from attempts by an unauthorized individual to gain access to the building, said door security system having a doorframe, said doorframe having a hinged vertical bar and a non-hinged vertical bar, wherein the non-hinged vertical bar has two bolt recesses, said door security system further having a door sized to fit within the doorframe, said door having an externally oriented surface facing the outside of the building and an internally oriented surface facing the inside of the building, said door having a horizontal upper edge, a horizontal lower edge, a vertical hinged edge, and a vertical free edge, said door having a plurality of hinge assemblies having hinge pins, said door having an open position, a closed position, a locked position, an unlocked position, and a plurality of vertical rods extending substantially between the lower edge and the upper edge of the door, said door further having a plurality of metal plates extending substantially from the hinged edge to the free edge of the door, said metal plates including a central plate which is centrally positioned upon the door, said central plate having two deadbolt locks positioned in proximity to the free edge of the door, each having a selectively extendable bolt, said central plate also having a cover plate having a projecting portion which is coplanar with the door and a perpendicular portion extending perpendicularly therefrom, said method comprising the steps of:

a) positioning the doorframe within the existing doorway;

b) attaching the doorframe to the existing doorway;

c) attaching the door to the doorframe by attaching the hinge assemblies to the hinged edge of the door and to the hinged vertical bar of the doorframe;

d) inserting the hinge pins within the hinge assemblies;

e) locking at least one of the deadbolt locks in order to prevent unauthorized access into the building;

f) preventing the unauthorized user from breaking the door, by the vertical rods welded to the horizontal upper edge and the horizontal lower edge;

g) preventing the unauthorized user from breaking the door, by the plates extending from the hinged edge to the free edge of the door; and h) preventing the unauthorized user from pushing the bolts out from their corresponding recesses, by the cover plate extending from the central plate.

* * * * *